United States Patent [19]

Cholet et al.

[11] Patent Number: 4,957,161

[45] Date of Patent: Sep. 18, 1990

[54] DEVICE FOR PUMPING A FLUID AT THE BOTTOM OF A WELL

[75] Inventors: Henri Cholet, Le Pecq; Edmond Chanton, Clamart, both of France

[73] Assignee: Institut Francais du Petrole, Malmaison, France

[21] Appl. No.: 352,017

[22] Filed: May 15, 1989

Related U.S. Application Data

[63] Continuation-in-part of Ser. No. 213,239, Jun. 29, 1988, abandoned.

[30] Foreign Application Priority Data

Jun. 30, 1987 [FR] France ..... 87 09231

[51] Int. Cl.[5] ..... F04B 47/14

[52] U.S. Cl. ..... 166/105; 417/360; 417/450; 418/48

[58] Field of Search ..... 166/68, 104, 105, 237; 285/140, 360, 361, 376, 401, 402; 417/410, 358, 360, 448, 460; 418/48

[56] References Cited

U.S. PATENT DOCUMENTS

| | | | |
|---|---|---|---|
| 1,523,928 | 1/1925 | Berney et al. | 285/376 |
| 2,111,176 | 3/1938 | Cox | 417/450 |
| 2,162,001 | 6/1939 | Cox | 417/450 |
| 2,918,014 | 12/1959 | Gould | 417/360 |
| 3,347,169 | 10/1967 | Cronin, Jr. et al. | 418/48 |
| 3,474,737 | 10/1969 | Norman et al. | 417/410 |
| 3,802,803 | 4/1974 | Bogdanov et al. | 418/48 |
| 4,334,834 | 6/1982 | Werner et al. | 417/360 |
| 4,592,427 | 6/1986 | Morgan | 418/48 |
| 4,718,824 | 1/1988 | Cholet et al. | 418/48 |

FOREIGN PATENT DOCUMENTS

| | | |
|---|---|---|
| 2566059 | 12/1985 | France . |
| 0399910 | 4/1966 | Switzerland . |
| 0436843 | 10/1935 | United Kingdom . |
| 0545878 | 6/1942 | United Kingdom . |
| 2085944 | 5/1982 | United Kingdom . |

*Primary Examiner*—Bruce M. Kisliuk

*Attorney, Agent, or Firm*—Fay, Sharpe, Beall, Fagan, Minnich & McKee

[57] ABSTRACT

The device comprises a tubing (4) whose lower end is connected to a seat (5) on which bears a gear pump (6). The pump (6) comprises a pump case whose lower portion (10*a*) is engaged in a bore (5*b*) of the pump seat (5) and is connected to a cylindrical heavy body (20) which facilitates placing the pump (6) in position and maintaining the pump (6) on the seat (5). The weight of the heavy body (20) is determined as a function of the gear pump characteristics. The invention may be applicable to the pumping of petroleum fluids.

11 Claims, 5 Drawing Sheets

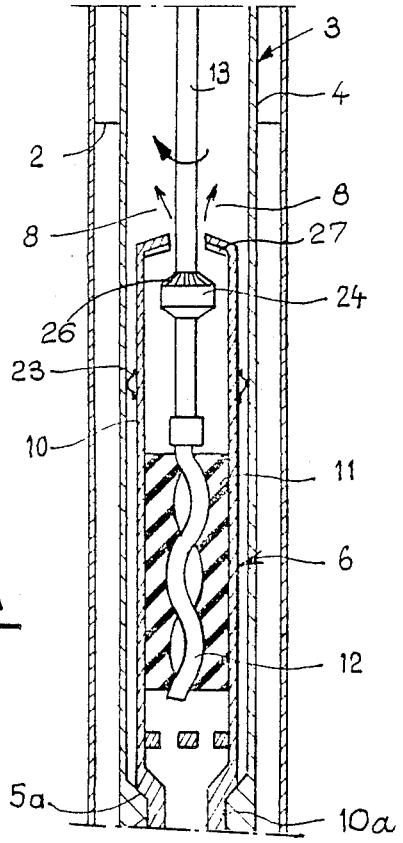
FIG. 1A
FIG.1C
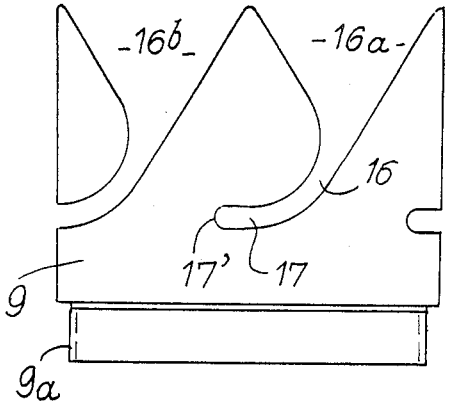

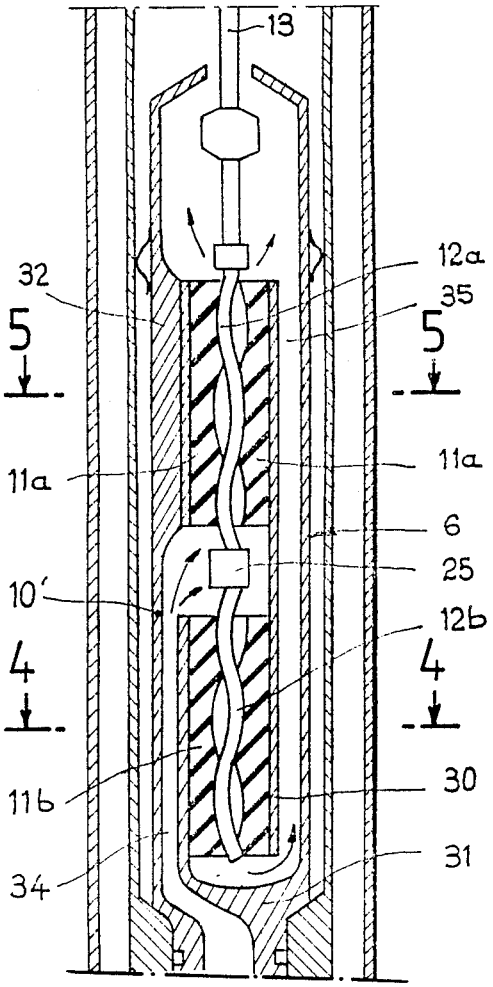
FIG.3
FIG.5
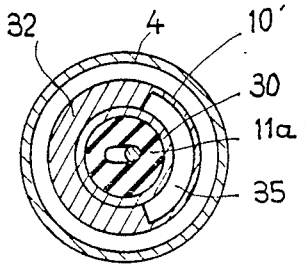
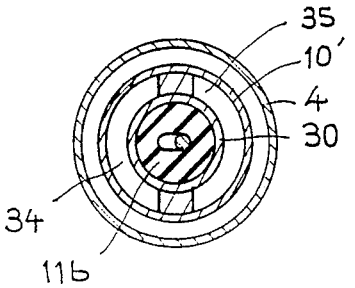
FIG.4

DEVICE FOR PUMPING A FLUID AT THE BOTTOM OF A WELL

This application is a continuation-in-part of U.S. application Ser. No. 213,239, filed on June 29, 1988 and now abandoned.

The invention relates to a device for pumping a fluid at the bottom of a well comprising a gear pump which is disposed in the lower end of a tubing and is capable of being easily raised to the surface.

Devices are known for pumping at the bottom of wells petroleum fluids or subterranean water coming from aquiferous sources. These pumping devices usually comprise a string of tubes or tubing disposed vertically along the axis of the well and a gear pump, for example a pump of the Moineau type, resting on a pump seat connected to the lower part of the tubing which plunges into the fluid to be pumped.

The pump of the Moineau type comprises a rotor of helical shape and a stator which is generally composed of an elastomer and whose central chamber in which the rotor rotates has a shape adapted to that of the rotor.

The stator constitutes the part of the pump which undergoes the most wear in service, for example when pumping a charged liquid.

When the stator is fixed either directly, or through the medium of a pump case, to the lower part of the tubing, the changing of a worn stator requires a complete raising of the tubing to the surface, which constitutes a very costly operation requiring the use of specialized equipment.

It has therefore been proposed, for example in the French patent FR-A-No. 2,566,059, to dispose at the base of the tubing a pump seat of tubular shape on which the stator of the pump comes to bear.

The rotor, which is driven in rotation from the surface by an electric motor, is connected to the lower end of a string of rods connected to the output shaft of the electric motor on the surface. Suspension and raising means may be associated with the string of rods for raising the rotor to the surface, and by means of said rotor, the stator whose chamber is engaged with the rotor. The raising of the whole of the tubing to the surface for replacing the stator is in this way avoided.

However, in order to block the stator in rotation, blocking means must be provided on the bearing part of the pump seat and a thrust must be exerted on the stator through the rotor-driving string of rods during the operation of the pump to ensure that the corresponding blocking means provided on the stator and the pump seat are maintained in contact. The thrust is exerted on the stator through an abutment disposed at the end of the string of rods connected to the rotor, making the rotor bear against the pump seat by means of the string of rotor-driving rods also permits ensuring the seal between the stator and the pump seat, sealing elements being provided between the corresponding bearing portions of these two parts.

In the case where the stator of the pump is fixed inside a pump case communicating with the inner volume of the tubing through its upper part, the lower part of the case comes to be engaged in the bore of the pump seat opening on to the fluid which must be pumped at the base of the tubing. However, in this case, it is difficult to place the pump case in the pump seat at great depth by means of the train of rods driving the rotor.

In any case, the placing in position of the pump and the maintenance of the stator requires a thrust to be exerted on the string of rods driving the rotor.

It is consequently impossible to in particular use this arrangement in the case of a pump whose electric motor is located in the vicinity of the rotor and is suspended in the tubing and supplied with electric current through cables.

Furthermore, the dynamic forces which occur during the operation of the pump and the screwing effect of the rotor have a tendency to cause the stator and the pump body to rise in the tubing.

An object of the invention is therefore to propose a device for pumping a fluid at the bottom of a well extending down from a surface, said device comprising tubing disposed vertically within the well and having a lower end plunging into the fluid and an upper end which opens onto the surface and through which the fluid is discharged, a gear pump bearing inside the tubing on a pump seat connected to the lower part of the tubing and comprising a pump case whose interior volume communicates with the interior volume of the tubing, at least one stator fixed in the case and at least one helical rotor rotatively mounted in the stator, means for driving the rotor and means for raising and suspending the pump in the tubing which are actuatable from the surface, the pump seat of tubular shape including on its inner surface a bearing portion for the pump case and being downwardly extended by an axially extending bore relative to the tubing and having a reduced diameter relative to the inside diameter of the tubing, opening onto the well and constituting a cavity for the lower portion of the pump case in which the fluid is aspirated, said device facilitating the positioning and the maintenance of the pump on the pump seat without exerting a thrust on the pump, irrespective of the manner of driving the rotor.

For this purpose, the lower portion of the pump case is connected to a cylindrical heavy body having a diameter less than the diameter of the bore of the pump seat, disposed in the axial extension of the pump case, the weight of the said heavy body being at least equal to the greatest of the two forces $F_1$ and $F_2$ given by the hereunder expressions:

$$F_1 = \frac{C_d}{\sqrt{4E^2 + R^2}} \times \frac{T}{\sqrt{T^2 + 4\pi^2 (4E^2 + R^2)}} \text{ and}$$

$$F_2 = (2E^2 + R^2)\pi \cdot \Delta P - S_j \cdot \Delta P + \frac{Cf}{\sqrt{4E^2 + R^2}} \times \frac{T}{\sqrt{T^2 + 4\pi^2 (4E^2 + R^2)}}$$

in which expressions:

E is the eccentricity of the rotor (in cm)

R is the radius of the rotor (in cm)

$\Delta P$ is the raise of pressure through the pump (in bars)

$S_j$ is the surface area of the transverse section of the sealing device of the pump case (in cm)

$C_d$ is the torque exerted on the rotor at the starting of the pump (in cm Kg)

$C_f$ is the torque when the pump is operated continuously (in cm Kg)

T is the pitch length of the stator (in cm).

In order to explain the invention, there will now be described, by way of non-limitative examples with reference to the accompanying drawings, several embodiments of a pumping device according to the invention.

FIG. 1A is a sectional view in a vertical plane of symmetry of a part comprising the pump proper of the device according to the invention in a first embodiment thereof.

FIG. 1C is a developed view of complementary means for blocking the pump carried by the pump seat.

FIG. 3 is a sectional view similar to FIGS. 1A and 2 of a pumping device according to the invention in a third embodiment thereof.

FIGS. 4 and 5 are cross-sectional views taken along diagonal lines 4—4 and 5—5 of FIG. 3 respectively.

Figure 1B:
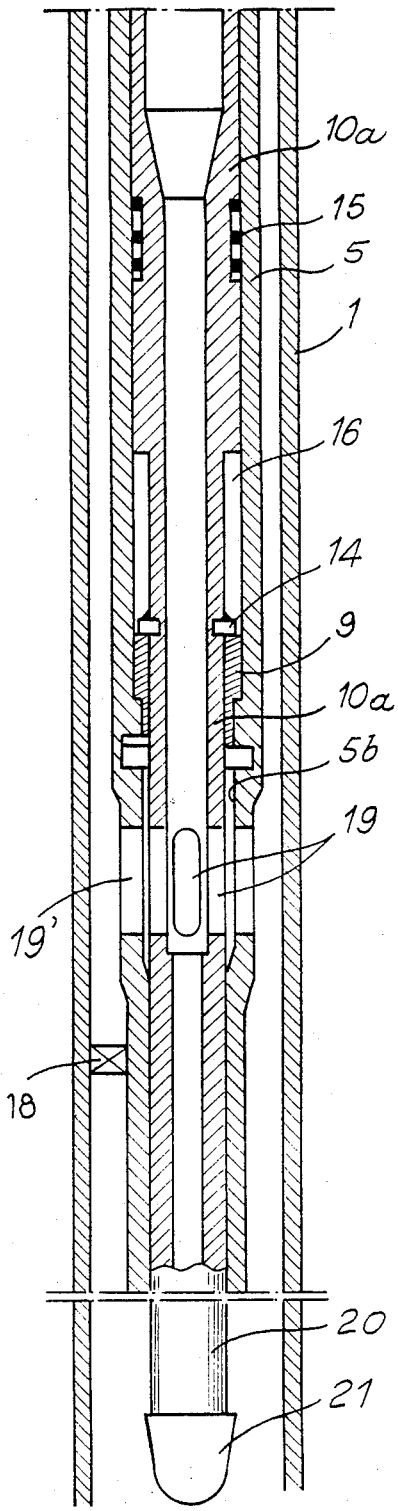
FIG. 1B is a sectional view of the lower end part, located below the pump, of the pumping device shown in FIG. 1A.
Figure 1D:
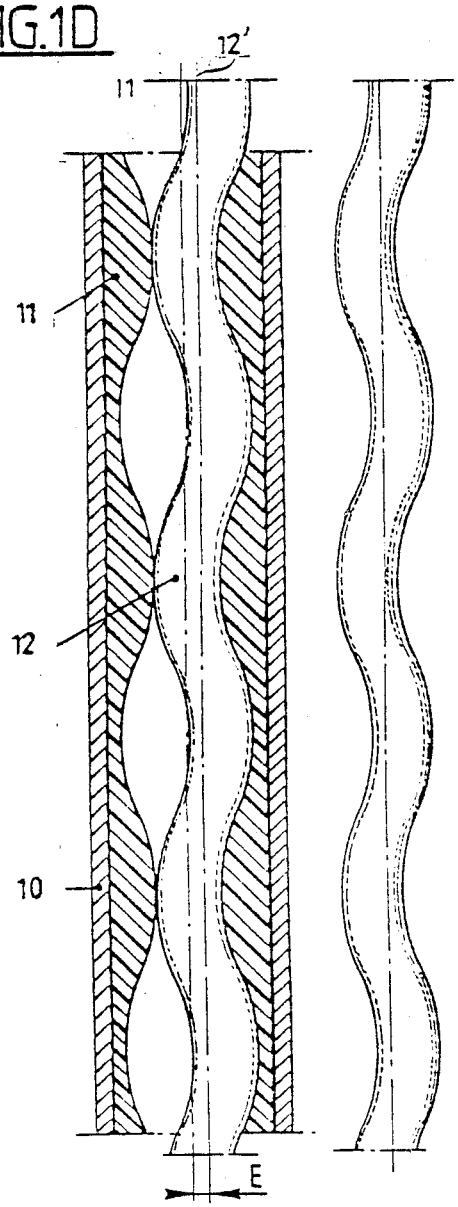
FIG. 1D is an enlarged view in longitudinal section of the stator and the rotor of a pumping device according to the first embodiment.
Figure 1F:
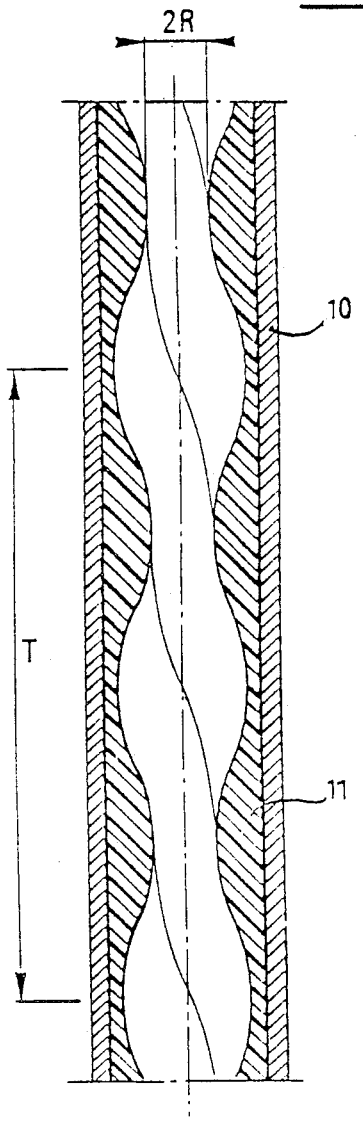
FIG. 1F is an enlarged view in longitudinal section of the stator alone of a pumping device according to the first embodiment.
Figure 1E:
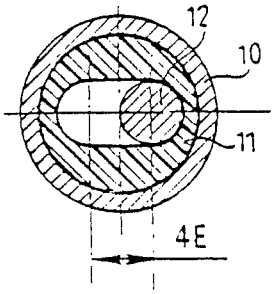
FIG. 1E is a cross sectional view of the stator and the rotor of FIG. 1D.
Figure 1G:
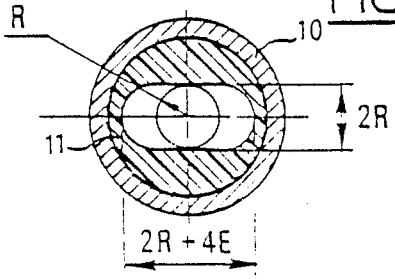
FIG. 1G is a cross sectional view of the stator of FIG. 1F.
Figure 2:
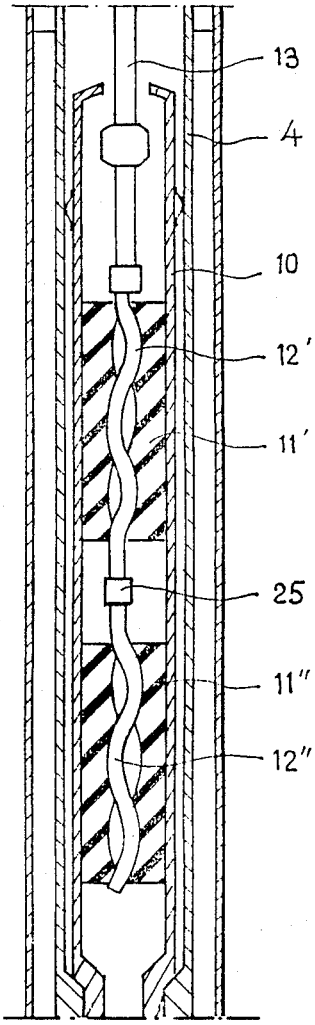
FIG. 2 is a sectional view similar to FIG. 1A of a pumping device according to the invention in a second embodiment thereof.
Figure 6:
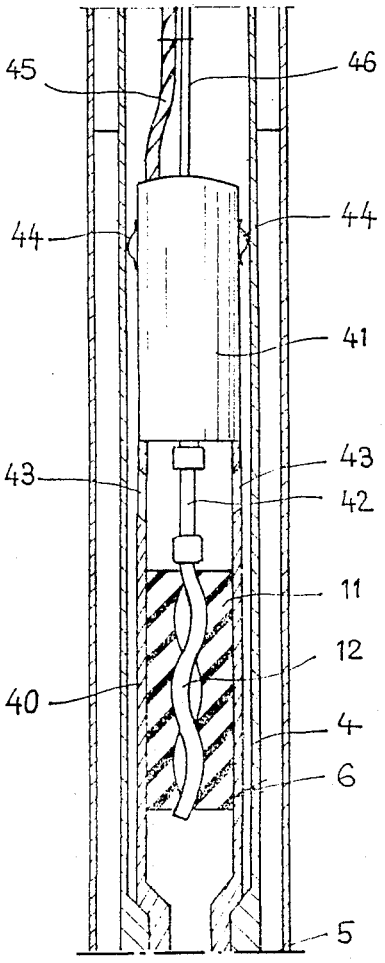

FIG. 6 is a sectional view similar to FIGS. 1A, 2 and 3 of a device according to the invention in a fourth embodiment thereof.

FIGS. 1A and 1B show a part of a well or bore-hole 1 having a great depth containing a liquid up to level 2. A pumping unit according to the invention generally designated by the reference character 3 has been inserted in the well for pumping the liquid.

This pumping device comprises tubing 4 of great length constituted by a succession of vertically disposed tubes substantially coaxial with the well 1. The upper end of the tubing 4 (not shown) opens onto the surface where the liquid discharged in the tubing 4 is recovered or eliminated.

The lower end of the tubing 4 which plunges into the liquid constitutes a seat 5 on which comes to bear a pump 6 which aspirates the liquid in the well 1 (arrows 7) and discharges it in the tubing (arrows 8).

The pump seat 5 connected to the lower part of the tubing 4 defines an inner surface constituting in succession, in the downward direction, a frustoconical bearing portion 5*a* and a bore 5*b* which extends axially relative to the tubing 4.

The pump 6 comprises a pump case 10, a stator 11 fixed in the case 10 and a rotor 12 rotatively engaged in the stator. The pump 6 is a gear pump of the Moineau type having a rotor 12 of helical shape and a stator 11 whose axially extending central chamber has a meridian curve which is shown in FIG. 1A and adapted to the shape of the rotor for providing a fluid-conveying region along the axis of the pump during the rotation of the rotor.

The rotor 12 is fixed to the end of a string of rods 13 for driving the rotor in rotation, the upper end (not shown in FIG. 1A) is connected to the output shaft of a motor placed on the surface.

The pump case 10 is open in its upper part to permit the passage of the string of rods 13 and the liquid on the periphery of the string of rods.

The lower part of the case 10 constitutes a tubular extension 10*a* of reduced diameter which is engaged substantially without clearance in the bore 5*b* of the pump seat 5. The junction region between the upper part of the case 10 in which the stator 11 is located and the lower part 10*a* constitutes a bearing surface of frustoconical shape corresponding to the frustoconical base 5*a* of the seat 5.

The outer surface of the lower tubular part 10*a* of the case 10 includes an annular cavity in which a sealing device 15 is disposed or providing a sealed mounting of the lower part 10*a* of the pump body in the bore 5*b* of the pump seat 5.

Provided at the end of the lower tubular portion 10*a* of the pump body 10 and in the pump seat 5 are coinciding openings 19 and 19' respectively for the passage of the fluid aspirated by the pump.

The lower part 10*a* of the pump case is connected below the openings 19 to a massive cylindrical bar 20 situated in the axial extension of the portion 10*a*.

The bar 20 is made from a dense material such as steel and has a diameter slightly smaller than the minimum inside diameter of the bore 5*b*. This bar constitutes a heavy body whose mass may be very much larger than the total mass of the pump.

It has been discovered that the bar 20 is able to maintain effectively the pump case on the pump seat both at the starting and during the normal operation of the pump provided that the mass of said bar is such that its weight is at least equal to the greatest of two forces $F_1$ and $F_2$ that can be defined as a function of certain characteristic parameters of the pump.

$F_1$ corresponds to the screwing effort of the rotor at the starting of the pump which tends to cause the stator and the pump case to rise in the tubing.

$F_2$ corresponds to the axial forces acting on the pump case during the continuous operation of the case.

The said forces are:

A tensile strength F exerted upwards on the string of rods which corresponds to the raise of pressure $\Delta P$ through the pump exerted on the surface s of the gear section of the pump, A force F' exerted downwards on the section S of the sealing device 15, by the raise of pressure $\Delta P$ through the pump, and the screwing effort F'' of the rotor during the continuous operation of the pump which tends to cause the stator to rise in the tubing.

Consequently, the force $F_2$ is equal to: $F-F'+F''$.

Moreover $F_1$, F, F', F'' and $F_2$ can be determined as functions of the following parameters of the pump:

E: the eccentricity of the rotor (expressed in cm)

R: the radius of the rotor (cm)

$\Delta P$: the raise of pressure through the pump (bars)

$S_j$: the surface area of the transverse section of the sealing device of the pump case. ($cm^2$)

$C_d$: the torque exerted on the rotor at the starting of the pump (cm kg)

$C_f$: the torque when the pump is being operated continously (cm kg) and

T: the pitch of the stator (cm).

The geometrical and dimensional parameters E, R and T have been shown in FIGS. 1D, 1E, 1F and 1G in which are represented the pump case 10, the stator 11, the rotor 12, the stator axis 11' and the rotor axis 12'.

$F_1$, F, F', F'' and $F_2$ have been determined according to the following expressions in the frame of the invention:

$$F_1 = \frac{Cd}{\sqrt{4E^2 + R^2}} \times \frac{T}{\sqrt{T^2 + 4\pi^2 (4E^2 + R^2)}}$$

$$F = (2E^2 + R^2) \cdot \pi \cdot \Delta P$$

$$F' = S_j \Delta P$$

$$F' = \frac{Cf}{\sqrt{4E^2 + R^2}} * \frac{T}{\sqrt{T^2 + 4\pi^2 (4E^2 + R^2)}}$$

and thus $$F_2 = F - F' + F''$$

When the minimum weight of the heavy body in the shape of a bar has been determined by calculating and comparing $F_1$ and $F_2$, the corresponding mass of the cylindrical bar (assuming it is made of steel) allows the minimum length of the said bar to be calculated.

In the hereunder table the minimal lengths of round steel bars used for maintaining a pump case have been given in the case of three different pumps having different characteristics and in the case where the bars have a diameter of 60 mm.

| Pump | 1 | 2 | 3 |
|---|---|---|---|
| minimal weight of the heavy body (kg) | 392 | 784 | 1474 |
| stator weight (kg) | 65 | 65 | 65 |
| Weight of the steel bar (kg) | 327 | 719 | 1409 |
| Length of the steel bar (ϕ 60 mm) (m) | 17 | 38 | 74 |

It can be seen that the stator weight is taken into account when calculating the minimal length of the bar. If the stator weight is not substracted from the minimal weight of the heavy body, the minimal calculated length is somewhat greater.

The lower end of the bar 20 is fixed to a terminal member 21 of elastomer of rounded shape, for example an ogival shape.

Complementary means for maintaining the pump case in the tubing will now be described with reference to FIGS. 1B and 1C.

Two radially extending studs 14 are fixed on the lower part 10*a* of the pump body in positions at 180° to each other.

The studs 14 are engaged in radially extending apertures in the pump case and fixed in position by welding. They have an outer portion which projects from the outer surface of the pump case.

A sleeve 9 is fixed coaxially in the bore 5*b* of the seat 5 by screwing a screw-threaded lower portion 9*a* of the sleeve in a corresponding tapped portion of the seat 5. The sleeve 9 is prevented from rotating by a key.

As can be seen in FIGS. 1B and 1C, the sleeve 9 includes two apertures of curved shape throughout the thickness of its lateral wall constituting two grooves 16*a*, 16*b* on the inner surface of the bore 5*b* in which the studs 14 are engaged when the pump body is in position on the seat 5. The grooves 16*a*, 16*b* have a radial depth which corresponds to the thickness of the sleeve 9 which is slightly greater than the length of the projecting portion of the studs 14.

The two grooves have the same shape and are located at 180° to each other on the periphery of the sleeve 9 (or of the bore 5).

Each groove 16 has a divergent and upwardly open upper entrance part having a certain extension in the axial direction, an intermediate part of curved shape extending in the axial and circumferential direction and an end part 17 extending in the circumferential direction and having an end 17' which constitutes a stop abutment for the corresponding stud 14. The curved intermediate part and the circumferential end part 17 extend in the direction of rotation of the rotor 12 indicated in FIG. 1A.

Interposed between the lower part of the pump seat 5 and the inner surface of the well 1 are in particular radially extending blocking devices such as 18 which limit the oscillations or vibrations of the seat 5 and tubing 4 inside the well 1.

Fixed on the outer surface of the upper portion of the pump case 10 are flexible centering devices 23 whose outer surface is in contact with the inner surface of the tubing 4.

An abutment 24 is fixed on the string of rods 13 above its junction region with the rotor 12 and below the upper opening of the pump case 10. The maximum diameter of the abutment 24 exceeds the diameter of the opening provided in the upper portion of the case 10 for the passage of the string of driving rods 13 and the fluid.

As can be seen in FIG. 1A, the abutment 24 has a set of teeth 26 which is cooperative with a set of teeth 27 provided on the inner surface of the pump case 10 in its upper part for connecting the string of rods 13 and the pump case 10 in rotation about the axis of the string of rods 13.

A suspension and raising device (not shown) is placed on the surface and is capable of being connected to the upper end of the string of rods 13.

When the stator 11 has undergone a certain amount of wear in service by the friction of the rotor 12, the efficiency of the pump decreases and it becomes necessary to change the stator. For this purpose, the device for raising the string of rods 13 is used for slightly disengaging the rotor 12 from the chamber of the stator 11. The string of rods 13 is raised until the abutment 24 comes to bear against the inner surface of the upper portion of the case 10. The teeth 26 and 27 then engage one another and the pump case is in this way connected in rotation with the string of rods 13. The string of rods and the pump case 10 are rotated in the direction opposed to the direction of the rotor 12 by exerting the corresponding torque on the upper part of the string of rods. The studs 14 are in this way disengaged from the part 17 of the grooves 16. The studs 14 then travel along the curved intermediate parts of the grooves 16 and reach the upwardly open divergent end part of these grooves.

The studs 14 of the pump case 10 caused to leave the grooves 16 by merely exerting an upward pull on the pump case 10 by means of the string of rods 13.

The pump 6 is then raised inside the tubing 4 by the raising device and through the medium of the string of rods 13. During this raising, the case 10 is guided in the tubing 4 by the bearing abutments 23.

The stator 11 is changed on the surface. Means for dismantling the case 10 (not shown in FIG. 1A) are provided for this purpose.

When the pump 6 is lowered for placing it back in position in the lower part of the tubing and when it is raised, the bar 20 constitutes ballast which puts the string of rods 13 of great length under tension. Furthermore, when lowering the pump, the weight of the ballast 20 acts as a driving element for moving the pump 6 in the tubing in opposition to the action of friction, for example in the region of the abutment shoes 23.

Before the end of the lowering of the pump, the terminal member 21 of the bar 20 of great length comes in contact with the bearing portion 5*a* and ensures the introduction of the end of the rod 20 into the bore 5*b* of the pump seat 5. The placing in position of the pump is pursued by vertically lowering it until the studs 14 come into engagement with the entrance part of the grooves 16. The studs 14 enter the grooves and continue to descend vertically until they come into contact with the curved intermediate part of the grooves. The pump case 10 and the string of rods 13 are then driven during their descent in the direction of rotation of the rotor 12. When the studs 14 reach the level of the end part 17 of the groove 16, the vertical movement is stopped and the positioning of the studs is completed by a rotation of the string of rods and the pump case in the direction of rotation of the rotor 12. The studs 14 come to abut against the bottom 17′ of the grooves 16 and are then blocked by the part 17 of the grooves against axial movement.

During the positioning of the pump case, the sealing O-rings 15 are placed in the bore 5*b* and the case 10 comes to bear against the bearing portion 5*a* of the pump seat.

When the studs 14 abut against the ends 17′ of the grooves, the positioning of the pump is terminated. The rotor may be placed back in its service position and rotated in the stator. The pump case is maintained efficiently on the pump seat by the weight of the bar 20, the length of which is calculated for obtaining the desired weight. The reactions of the rotor on the stator and on the pump case result in the studs 14 being put into bearing relation to the bottom 17′ of the grooves with an increased force. The studs 14 cannot leave the part 17 of the grooves and in this way provide a complementary axial blocking of the pump which is perfectly maintained in position in the tubing not withstanding the induced vibrations. Furthermore, the screwing action of the rotor maintains the studs at the end of the grooves.

FIGS. 2 and 3 show two modifications of the pumping unit, the corresponding elements in FIG. 1A and FIGS. 2 and 3 carrying the same reference characters. The lower part of the pumping devices of FIGS. 2 and 3 is identical to the lower part of the device shown in FIGS. 1B and 1C.

The pumping unit shown in FIG. 2 comprises within the pump case 10 two identical stators 11′ and 11″ arranged axially in succession with a slight clearance therebetween.

Fixed to the end of the string of driving rods 13 are two rotors 12′ and 12″, one after the other, the rotor 12′ being rotatively mounted in the stator 11′ and the rotor 12″ in the stator 11″. The rotors 12′ and 12″ may be preferably interconnected by a double universal joint 25 which enables the second rotor to move correctly in the second stator.

The universal joint 25 may be replaced by a flexible junction element, for example a flexible bar.

The device shown in FIG. 2 enables the fluid discharge pressure in the tubing 4 to be increased, the gain in pressure of the first pumping stage 11″, 12″ being multiplied by the pumping gain of the second stage 11′, 12′.

When the pumping unit is in operation, it is maintained by elements identical to those shown in FIGS. 1B and 1C. Such an assembly would not be possible or would be difficult to realize in the case where a pressure would have to be exerted on the stators through the string of rods 13.

FIG. 3 and FIGS. 4, 5 and 6 show a third embodiment of a pumping device according to the invention in which the pump 6 comprises, within a case 10′ of special shape, two stators, 11*a* and 11*b* in which are rotatively mounted a first helical rotor 12*a* and a second helical rotor 12*b* respectively. The rotors 12*a* and 12*b* are fixed one after the other to the end of the driving rod 13 and interconnected by a double universal joint. The stators 11*a* and 11*b* are fixed inside the case 10′ by means of a tubular support 30 fixed in its lower part to a separation wall 31 of the inner volume of the case 10′ and in its upper part to a radially projecting portion 32 of the case 10′. The tubular support 30 and the portions 31 and 32 of the case 10′ define within said case fluid circulating passageways comprising an inlet passageway 34 and an outlet passageway 35 for the fluid. The pumping unit 11*a*, 12*a* aspirates the fluid in the inlet passageway 34 and discharges this fluid directly into the upper part of the case 10′. The pumping unit 11*b*, 12*b* also aspirates the fluid in the inlet passageway 34 and discharges it through the outlet passageway 35 which communicates with the upper part of the case 10′. In this way, the two pumping units are connected in parallel and permit the aspiration of the double flow of fluid through the inlet passageway 34 and the lower tubular part of the pump case 10′. The two rotors have threads or pitches of opposite hands and are mounted in opposed relation, and the two pumping units operate in opposite directions.

As before, the device may operate without bearing on the stators and the pump 6 can be easily placed in its service position in the tubing by acting on the string of rods 13 from the surface.

In FIG. 6, a fourth embodiment of the pumping device is shown which is identical to the first embodiment shown in FIG. 1A except for the means driving the rotor 12 and the suspension and raising means for the pump 6 in the tubing 4.

The string of rods 13 for driving the rotor 12 is replaced by an electric motor 41 connected to the upper portion of the pump case 40 in which the stator 11 is fixed. The output shaft 42 of the motor 41 is of short length and connected to the rotor 12 which is driven in rotation thereby.

Openings 43 extend through the wall of the case 40 above the stator 11. When the pump is in operation, the fluid arriving in the upper part of the pump case 40 is discharged into the tubing 4 through the openings 43. The fluid then flows upwardly in the annular space on the periphery of the electric motor 41, the presence of the electric motor reducing the section of the passage of the fluid in the tubing. This section is still further slightly reduced by the presence of centering elements 44 fixed to the outer surface of the motor 41 and coming into contact with the inner surface of the tubing 4. The remaining section is however sufficient to permit a pumping and a circulation of the fluid under satisfactory conditions. This circulation avoids an excessive heating of the motor.

The electric motor 41 is supplied with power through a cable 45 connected to the upper part of the motor 41.

The end of the cable 45 is connected to a source of electric current on the surface.

The pumping unit 6 is suspended from a carrying cable 46 whose end remote from the motor 41 is wound around a raising device such as a winch on the surface.

There would be no departure from the scope of the invention if a single cable performed the functions of a power supply cable and a carrying cable.

As in the foregoing embodiments, the pumping unit 6 is placed in position and maintained in service by the lower part of the case 40 (not shown) and by a heavy body.

In this embodiment, the reaction on the stator when the rotor rotates is supported by the case 40 connected to the motor 41.

As before, the pump case and the stator in service are maintained with no necessity to exert a thrust on the stator. Moreover, it would not be possible to exert this thrust, since the connecting element between the pump 6 and the surface is a flexible cable 46.

When the pump 6 is lowered and placed in position in the lower part of the tubing 4, the heavy body puts the cable 46 under tension.

The use of a driving motor may also be applied in particular to the embodiment shown in FIGS. 2 and 3.

The embodiment shown in FIG. 6 has many advantages over the embodiments of pumping devices employing an integrated electric motor of the prior art.

In particular, the fact of disposing the electric driving motor 41 above the pump proper 11, 12 permits the arrangement of power supply connections outside the heating region of the pump which is located in the region of the rubbing component parts, and in particular the bearings. Moreover, a connection chamber may be provided which has a larger volume than in the devices of the prior art. A supply cable 45 of round section without splicing may also be used. In the case of the prior art, the cable must be flattened to permit its passage at the periphery of the pump and motor.

Furthermore, positioning the supply cable above the pumping unit avoids any risk of deterioration of this cable when the pump is placed in position or extracted.

It will be quite clear that the advantages of the device shown in FIG. 6 are transposable to rotary pumps which are different from gear pumps.

It is also quite clear that the electric motor may be replaced by a motor of another type, for example a hydraulic or pneumatic motor.

In any case, the devices just described permit a ready positioning and an effective maintenance against the screwing effect of the rotor and against vibrations of a pump on a pump seat located in the lower part of a tubing.

The scope of the invention is not intended to be limited to the embodiments described.

The heavy body connected to the lower part of the pump case could be constituted by a cylindrical element different from a plain steel bar the length of which is determined by the necessary weight of the body.

The use may be imagined of a heavy body composed of some dense material fixed to the lower part of the pump case in a suitable manner.

It is possible to imagine arranging the studs and the blocking grooves in a manner other than that described. In particular, the grooves may be machined directly in the bore of the pump seat instead of being machined in a sleeve mounted inside the bore.

The shape and number of blocking grooves may be different from those described. More than two studs fixed to the pump case may be used or, on the contrary, a single stud may be used which cooperates with a single groove.

We claim:

1. A device for pumping a fluid at a bottom of a well extending down from a surface, said device comprising tubing disposed vertically within the well and having a lower end part plunging into the fluid and an upper end which opens out on the surface and through which upper end the fluid is discharged, a pump seat connected to the lower part of the tubing, a gear pump being on the pump seat inside the tubing and comprising a pump case having a lower portion and an inner volume which communicates with an inner volume of the tubing, at least one stator fixed in the case and at least one helical rotor rotatively mounted in the stator, means for driving the rotor, and means for raising and suspending the pump in the tubing, said driving and raising means being actuatable from the surface, the pump seat having a tubular shape and including on an inner surface thereof, a bearing portion for the pump case, a bore downwardly extending the bearing portion axially of the tubing and having a reduced diameter relative to an inside diameter of the tubing and opening onto the fluid and constituting a cavity for the lower portion of the pump case in which the fluid is aspirated, wherein the lower portion of the pump case is connected to a cylindrical heavy body having a diameter less than the diameter of the bore of the pump seat, disposed in the axial extension of the pump case, the weight of the said heavy body being at least equal to the greatest of the two forces $F_1$ and $F_2$ given by the hereunder expressions:

$$F_1 = \frac{C_d}{\sqrt{4E^2 + R^2}} \times \frac{T}{\sqrt{T^2 + 4\pi^2 (4E^2 + R^2)}} \text{ and}$$

$$F_2 = (2E^2 + R^2)\pi \cdot \Delta P - S_j \cdot \Delta P + \frac{Cf}{\sqrt{4E^2 + R^2}} \times \frac{T}{\sqrt{T^2 + 4\pi^2 (4E^2 + R^2)}}$$

in which expressions:

E is the eccentricity of the rotor (in cm)

R is the radius of the rotor (in cm)

$\Delta P$ is the raise of pressure through the pump (in bars)

$S_j$ is the surface area of the transverse section of the sealing device of the pump case (in $cm^2$)

$C_d$ is the torque exerted on the rotor at the starting of the pump (in cm Kg)

$C_f$ is the torque then the pump is operated continuously (in cm Kg)

T is the pitch length of the stator (in cm).

2. A device according to claim 1 wherein the lower portion of the pump case located inside the bore of the pump seat further comprises at least one radially projecting stud and the pump seat comprises, in the inner bore thereof, at least one blocking groove having a depth in the radial direction and extending longitudinally and circumferentially in such manner that the stud of the pump case is capable of engaging in the groove when the pump case is placed in position in the tubing by axially lowering the pump case, then coming into abutting relation to an end of the groove after a rotation of the pump case in the direction of rotation of the rotor, a terminal part of the groove extending in a substantially circumferential direction for axially maintaining the pump case in the tubing.

3. A device according to claim 1, wherein the cylindrical heavy body is constituted by a solid metal bar of great length.

4. A device according to claim 3, wherein a terminal member composed of a plastics material and having a rounded shape is fixed to an end of the metal bar.

5. A device according to claim 2, wherein said driving means and said raising means comprise a string of rods, an abutment is connected to the string of rods in a part of the string of rods connected to the rotor, within the case, the abutment comprises a set of teeth, the pump case has an inner surface defining a set of teeth cooperative with the set of teeth of the abutment for connecting in rotation the string of rods with the pump case in a raised position of the string of rods relative to the pump case so as to disengage the stud from the groove by rotation of the rotor in the stator.

6. A device according to claim 2, comprising a sleeve mounted within the bore of the pump seat, said groove being formed in a wall of the sleeve.

7. A device according to claim 2, wherein said groove comprises an upwardly open divergent upper part, a curved intermediate part extending in a both axial and circumferential direction, and a circumferential lower end part.

8. A device according to claim 2, comprising two of said stud placed at 180° to each other on the periphery of the pump case and two of said groove disposed at 180° to each other on an inner periphery of the bore of the pump seat and respectively cooperative with the two studs.

9. A device according to claim 1, comprising within the pump case at least two stators and two rotors which are each mounted in a respective stator, fixed to each other in succession and constitute two pumping elements in series relation to each other.

10. A device according to claim 1, comprising, within the pump case at least two stators and two rotors which are each mounted in a respective stator, fixed to each other in succession and constitute two pumping elements operative in parallel owing to provision of separating elements within the pump case.

11. A device according to claim 1, wherein the means for driving the rotor are constituted by a motor, current supply means on the surface and electrically connected to the motor which is connected to an upper portion of the pump case, said suspending and raising means comprising a cable fixed to an upper end of the motor and associated with hoisting means on the surface.

* * * * *